US007631454B2

(12) United States Patent
Kelly et al.

(10) Patent No.: US 7,631,454 B2
(45) Date of Patent: Dec. 15, 2009

(54) BALL PROPELLING MACHINE

(76) Inventors: Haydn Kelly, 147 Springvale Drive, Weetangera (AU) 2614; Colin Brodrick, 6 Fernleigh Drive, Googong (AU) 2620

( * ) Notice: Subject to any disclaimer, the term of this patent is extended or adjusted under 35 U.S.C. 154(b) by 189 days.

(21) Appl. No.: 11/813,853

(22) PCT Filed: Jan. 20, 2006

(86) PCT No.: PCT/AU2006/000062

§ 371 (c)(1),
(2), (4) Date: Jul. 12, 2007

(87) PCT Pub. No.: WO2006/089345

PCT Pub. Date: Aug. 31, 2006

(65) Prior Publication Data

US 2008/0141992 A1 Jun. 19, 2008

(30) Foreign Application Priority Data

Jan. 20, 2005 (AU) ..... 2005900234

(51) Int. Cl.
*F41C 27/00* (2006.01)

(52) U.S. Cl. ..... 42/76.01; 124/81; 124/83

(58) Field of Classification Search ..... 42/76.01; 124/83, 81

See application file for complete search history.

(56) References Cited

U.S. PATENT DOCUMENTS 855,439 A * 6/1907 Adrianson ..... 42/76.01
2,526,018 A 10/1950 Foster
2,779,323 A * 1/1957 Thomsen ..... 124/83
3,288,127 A * 11/1966 Bullock ..... 124/81
3,662,729 A 5/1972 Henderson
3,855,988 A * 12/1974 Sweeton ..... 124/82
4,021,037 A * 5/1977 Torbet ..... 124/56
4,176,487 A * 12/1979 Manis ..... 42/76.01
4,207,857 A * 6/1980 Balka, Jr. ..... 124/56
4,379,531 A * 4/1983 Manis ..... 244/3.23
4,951,644 A 8/1990 Bon
5,133,330 A * 7/1992 Sharp ..... 124/56
6,202,636 B1 3/2001 O'Brien
6,295,752 B1 * 10/2001 Havlock ..... 42/76.01
6,453,593 B1 * 9/2002 Dillon ..... 42/76.01

FOREIGN PATENT DOCUMENTS

AU PCT/AU2003/001188 9/2003
AU 2005900234 1/2005
SU 1362487 12/1987

* cited by examiner

*Primary Examiner*—Michael Carone
*Assistant Examiner*—Jonathan C. Weber
(74) *Attorney, Agent, or Firm*—Steven A. Nielsen; Allman & Nielsen, P.C.; NielsenPatents.com

(57) ABSTRACT

A barrel (14)for a gas powered ball machine of the type used to simulate balls propelled whilst playing ball sports, especially those machines used to propel balls with a raised seam, such as a baseball or softball. The barrel (14) has one or more openings (160) along its cylindrical length that allow expanding gas to escape as a ball is fired from the machine. The openings (160) assist in predicting the pressure and volume of gas required to repeatedly propel a ball at a predetermined speed from the ball machine.

5 Claims, 4 Drawing Sheets

BALL PROPELLING MACHINE

FIELD OF THE INVENTION

The present invention relates generally to expanding gas powered ball machines of the type used to simulate balls propelled whilst playing ball sports. More particularly, the invention relates to a barrel assembly for use in a ball machine. Preferably the barrel is used in conjunction with seamed balls, such as those used in baseball or softball.

BACKGROUND ART

For a number of years, ball propelling machines have been used as a training aid in a variety of sports. Whilst there are a number of different types of ball machines presently available, machines employing expanding gas, such as compressed air, to propel the ball from the machine offer distinct advantages over other types that use counter-rotating wheels or a mechanical arm. In particular, machines employing expanded gas can more easily be adapted to accurately apply spin to a ball prior to firing. Thereby, these machines are better able to simulate balls thrown in actual games, such as the curveball or fastball thrown by pitchers in baseball.

An example of a ball machine which uses expanding gas is described in co-pending International Application No. PCT/AU2003/001188, which is an earlier application of the present inventors. This application describes a pitching machine which uses expanding gas to propel a ball down a barrel towards a target. A predetermined amount of spin can be applied to the ball prior to firing so as to simulate different types of pitches. PCT/AU2003/001188 is hereby incorporated in its entirety by cross-reference. AU 2004904357 is another application of the present inventors that discloses a ball machine which uses expanding gas. AU 2004904357 is also incorporated in its entirety by cross-reference.

At least in theory, the velocity of a ball fired from an expanding gas powered ball machine is proportional to the pressure of the compressed gas used to prime the machine. Accordingly, adjusting the pressure of the compressed gas used should predetermine the velocity of a ball fired from the machine. However, to date, there have been difficulties in manufacturing a machine that can accurately and repeatedly propel a seamed ball at a desired velocity, even where identical gas pressure has been employed.

Accordingly, there exists a need in the art for an expanding gas powered ball machine that offers advantages in terms of accurately and repeatedly imparting a predetermined velocity to a seamed ball propelled therefrom.

SUMMARY OF INVENTION

The invention aims to provide a barrel for an expanding gas powered ball machine which is an alternative to known barrels, and an expanding gas powered ball machine comprising said barrel.

In one aspect the invention resides broadly in a barrel for an expanding gas powered ball machine, including:

a plurality of openings in a cylindrical section of the barrel, wherein expanding gas can escape through the openings as a ball is fired from the barrel.

In another aspect, the invention resides in an expanding gas powered ball machine, including:

a barrel, and a plurality of openings in a cylindrical section of the barrel, wherein expanding gas can escape through the openings as a ball is fired from the barrel.

Preferably, the number, pattern or distribution, size and shape of the openings, are such that the speed of a ball fired from the barrel can be accurately and repeatedly predicted from the pressure and volume of gas used to propel the ball.

Preferably, the openings in the barrel are circular holes or slots. More preferably, the openings are circular holes of 0.5-20 mm in diameter. Even more preferably, the holes are 5-17 mm in diameter. Most preferably, the holes are 10-15 mm in diameter.

Preferably, the barrel contains at least 5 openings. More preferably, the barrel contains at least 20 openings. Even more preferably, the barrel contains at least 40 openings. Most preferably, the barrel contains at least 80 openings.

Preferably, the openings are concentrated at one end of the barrel proximal to the ball machine. Preferably, the openings are concentrated on opposing sides of the cylindrical section of the barrel.

According to a highly preferred embodiment, the barrel has two groups of at least 20 circular holes of 10-15 mm diameter, each group being concentrated on opposing sides of the barrel, and towards the end of the barrel proximal to the ball machine.

In a further aspect, the invention resides broadly in a barrel for an expanding gas powered ball machine, including:

a plurality of openings in a cylindrical section of the barrel, and one or more grooves in an inner surface of the cylindrical section of the barrel.

Preferably, the one or more grooves are circular in shape and in a plane substantially perpendicular to the longitudinal axis of the barrel. Preferably, the bottoms of the grooves are angular in shape. It is also preferred that the one or more grooves are evenly spaced along the full length of the inner cylindrical surface of the barrel.

Preferably, the barrel contains at least 5 grooves. More preferably, the barrel contains at least 10 grooves. Even more preferably, the barrel contains at least 15 grooves. Most preferably, the barrel contains at least 20 grooves.

In a highly preferred embodiment, at least some of the grooves are separated by openings in the cylindrical section of the barrel.

In another aspect, the present invention resides in a barrel for use in conjunction with a ball machine of the type which employs compressed gas to propel a loaded ball toward a target, comprising:

a first opening in the barrel capable of receiving a ball to be propelled from the ball machine;

a second opening in the barrel through which a propelled ball can exit the ball machine;

one or more apertures in the barrel between the first and second openings;

wherein the one or more apertures between the first and second openings are of a size and/or shape such that a ball used with the barrel is unable to pass through. Preferably, the ball is a baseball, softball or other ball with a raised seam.

Additional preferred features of the invention will be apparent from the dependant claims and from the following description of the preferred embodiment.

BRIEF DESCRIPTION OF DRAWINGS

The invention will now be described in a non-limiting manner with respect to a preferred embodiment in which.

DETAILED DESCRIPTION OF PREFERRED EMBODIMENT

Figure 1:
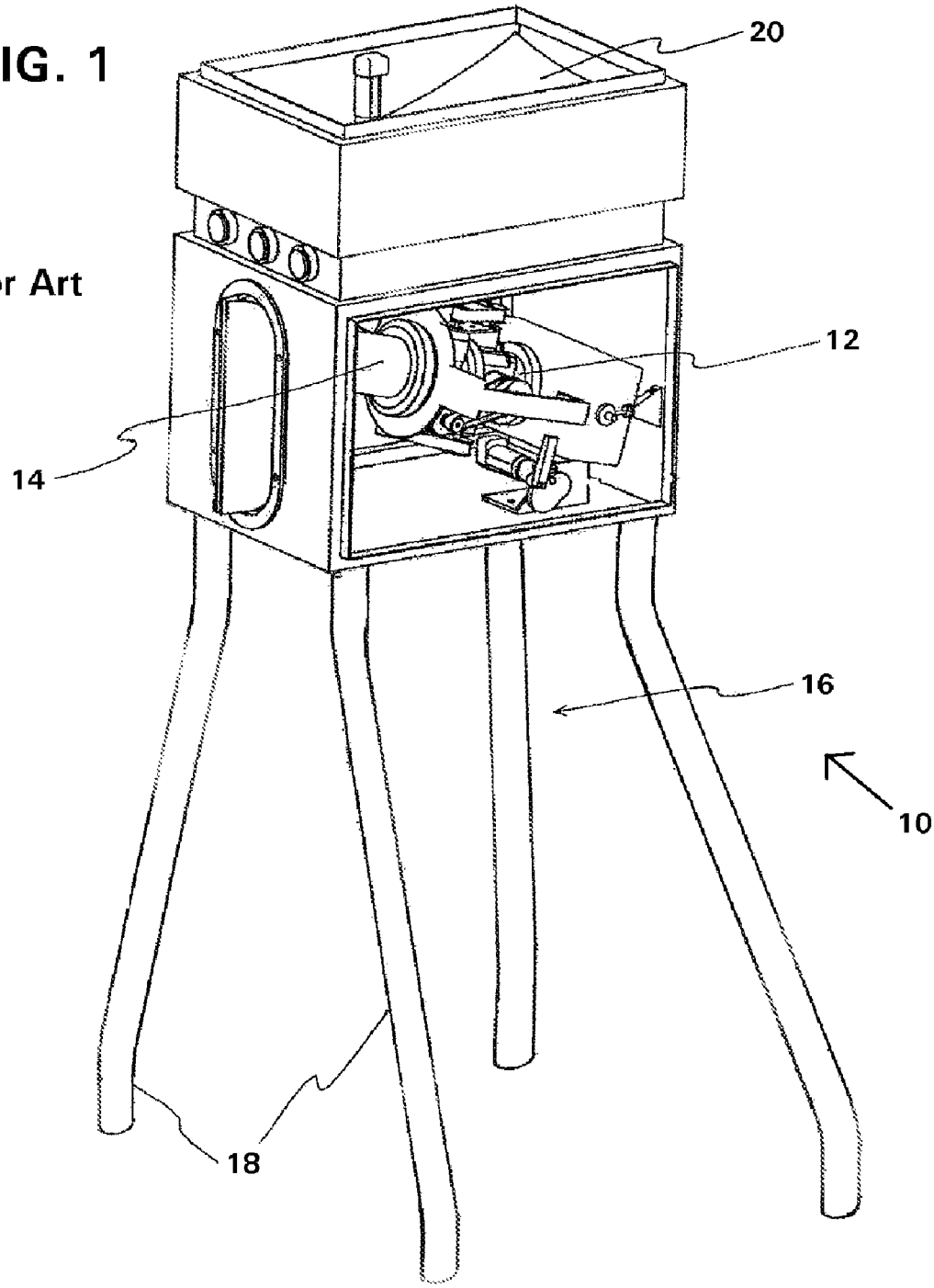
FIG. 1 Prior Art
FIG. 1 is a perspective view of a prior art expanding gas powered ball machine.

FIG. 1 depicts a prior art ball propelling machine 10 that can utilise a barrel assembly according to the preferred embodiment of the present invention. Typically, the ball propelling machine will include a ball firing component 12 with barrel 14, stand 16 with legs 18, and ball feed 20. The ball firing component 12 is connected to a source of compressed gas, such as a cylinder of compressed air or powered compressor, via an air inlet hose.

While compressed air is preferred for propelling the ball, it would be readily appreciated by the skilled addressee that other expanding gases may be used. For example, the ball machine could be used in conjunction with a combustible gas and ignition source.

In operation, a seamed ball, such as a baseball or softball, is positioned prior to firing in ball firing component 12. Upon firing, compressed air is supplied to ball firing component 12 and forces the ball from ball firing component 12 through barrel 14 toward the target. For further details, see PCT/AU2003/001188 and AU 2004904357.

As noted earlier, seamed balls projected from expanding gas powered ball machines often have different velocities even when the same amount of compressed gas has been used to propel the ball. In attempting to overcome this deficiency, it has been surprisingly discovered by the present inventors that the velocity of a seamed ball projected from a barrel with a plurality of openings in its cylindrical surface can be more accurately predicted, when compared with an identical barrel with no openings.

While not wishing to be bound by theory, the present inventors surmise that adding openings to the barrel may assist in the even distribution of gas pressure over the entire surface of the ball and thereby help to compensate for the slightly non-spherical shape of seamed balls.

Figure 2:
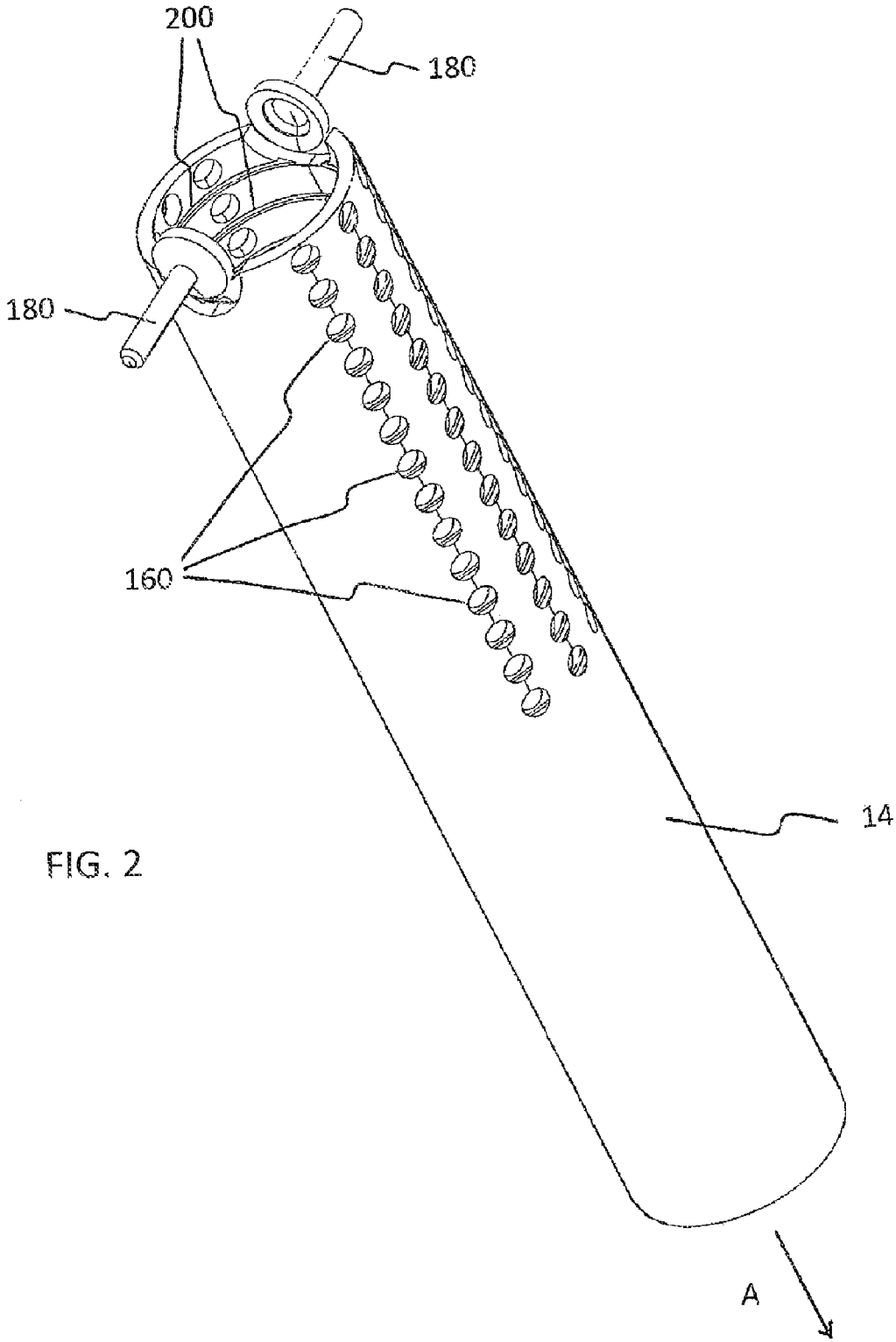
FIG. 2 is a perspective view of an improved barrel assembly according to the present invention.

FIG. 2 depicts a perspective view of a barrel assembly 14 of the present invention with openings 160. Upon firing, a loaded ball is propelled in the direction of arrow A.

It will be appreciated by the skilled artisan that, upon firing, some of the expanding gas escapes via the openings 160 in the cylindrical surface of the barrel 14 and thus the efficiency of the ball machine is reduced. Thus, where openings are added to the barrel, greater gas pressure is generally required to achieve the equivalent velocity to that achieved when firing a ball from a conventional barrel. By simple experimentation the optimum balance between the amount of air allowed to escape through the openings and the accuracy required in terms of predicting the velocity of a fired ball can be determined. For example, changes in the size, distribution and number of openings can be made.

According to the present invention, a highly preferred configuration is depicted in FIG. 2. The barrel of FIG. 2 has three rows of fourteen holes on opposing sides of the barrel. The openings are circular in shape with a diameter of approximately 10-15 mm and extend approximately halfway along the length of the barrel. In addition, FIG. 2 depicts a configuration highly suitable for use in conjunction with a ball spinning assembly, including ball supports 180, for spinning a loaded ball. Again, see PCT/AU2003/001188 and AU 2004904357 for further details regarding the ball supports and spinning functionality.

It has been found that a plurality of openings spaced along the full length of the barrel is also effective in accurately applying a predetermined velocity to a ball propelled from the barrel. The openings are preferably concentrated on opposing sides of the barrel, rather than evenly distributed around the whole cylindrical surface of the barrel.

In view of the discussion above, it would be apparent to the skilled addressee that other patterns, number, size or shape of openings could be employed to achieve the same effect. Suitable configurations could readily be determined by simple experimentation by the skilled addressee.

FIG. 2 also depicts channels or grooves 200 that can be added to the internal cylindrical surface of the barrel. These grooves have been found by the present inventors to further assist in accurately predicting the velocity of a projected ball. Preferably, the bottom of the grooves 200 have angular corners as depicted more clearly in FIG. 3 at 22. Alternatively, a groove with a rounded bottom, not depicted, could be employed. Again, while not wishing to be bound by any particular theory, the present inventors believe that the grooves assist in the even distribution of gas pressure over the entire surface of the ball.

Figure 3:
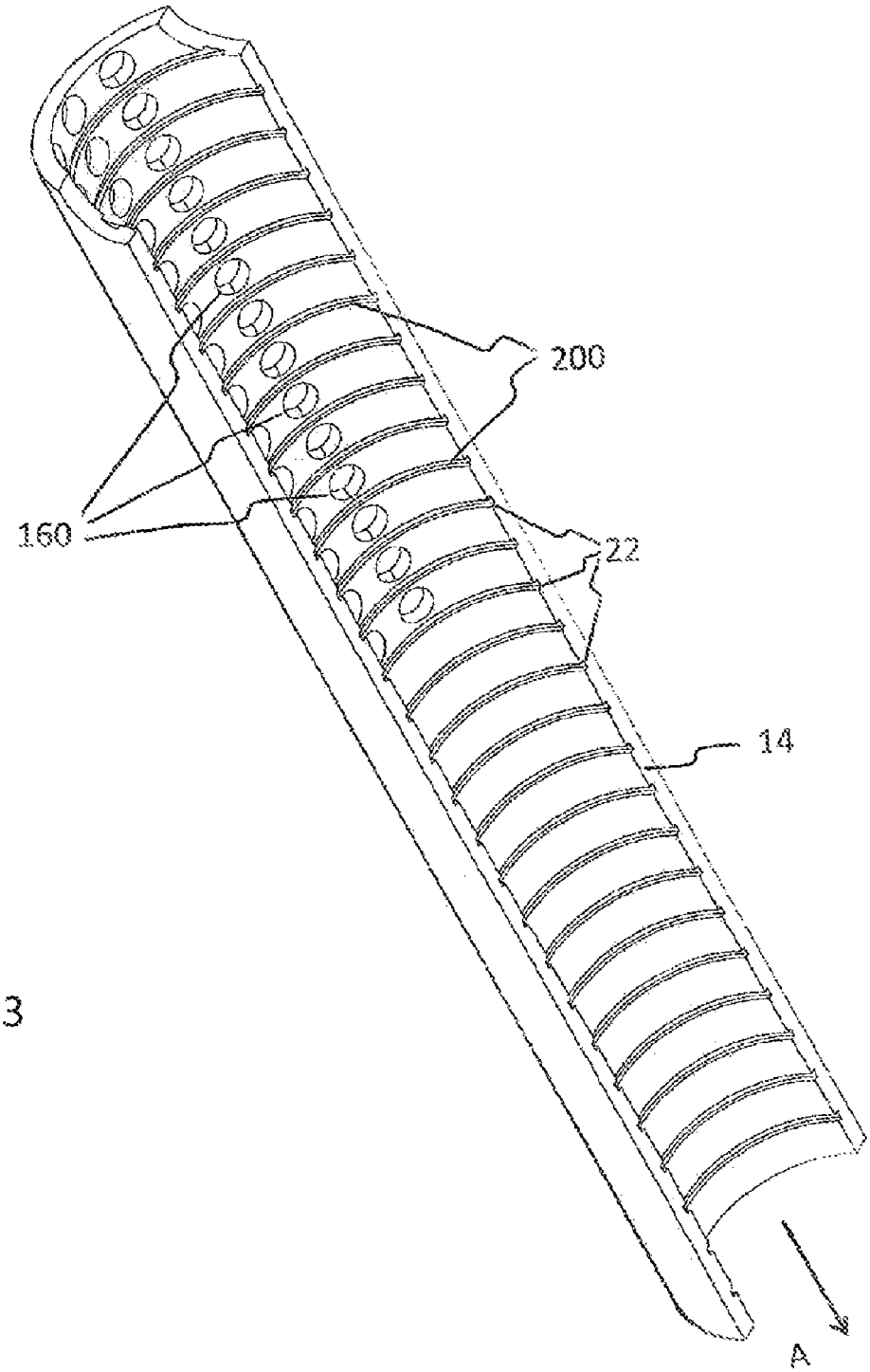
FIGS. 3 and 4 are perspective views of a barrel according to the present invention which has been sectioned along its longitudinal axis to show one half and one quarter of the complete barrel, respectively.
Figure 4:
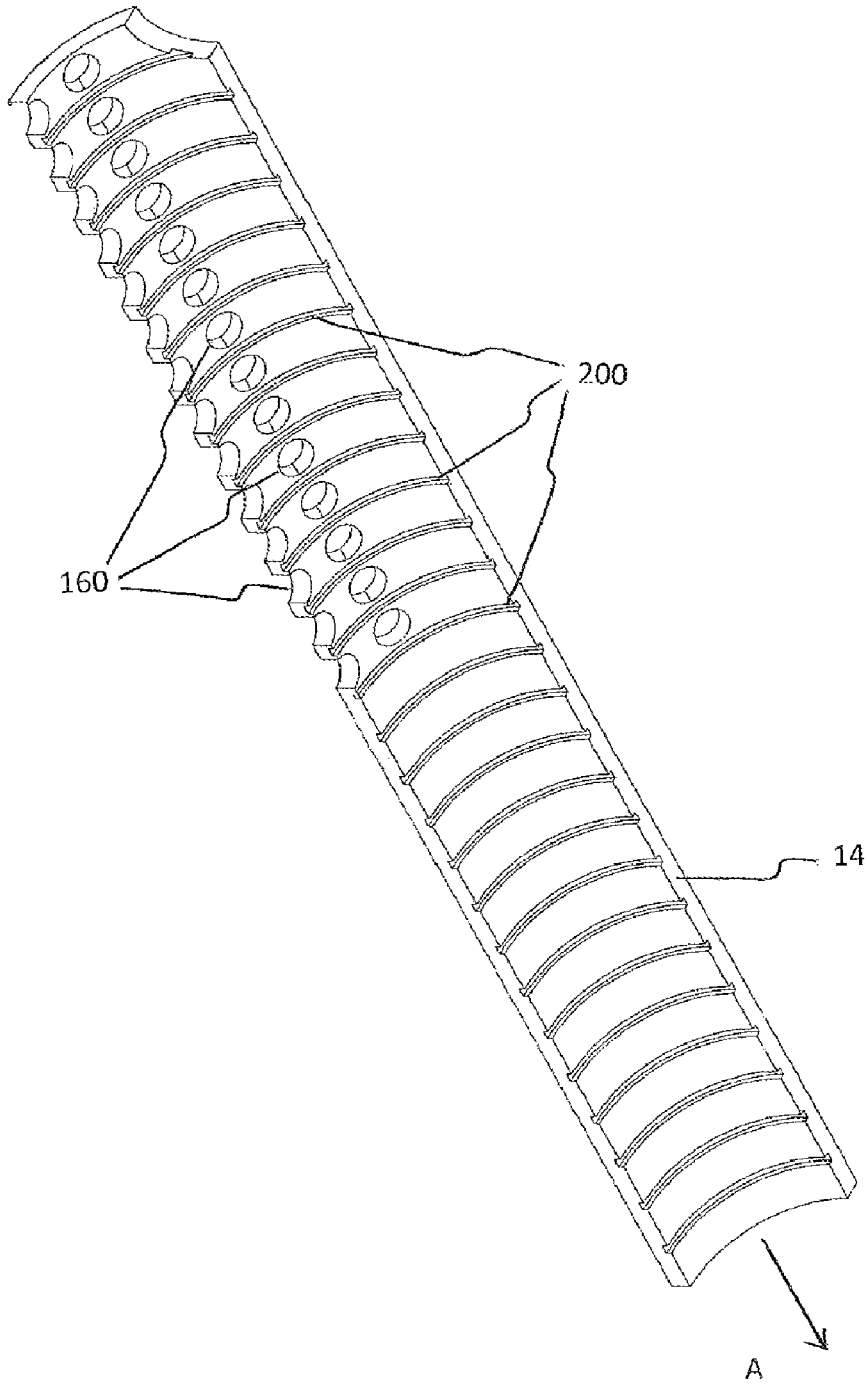

The grooves can be circular, oval or any other shape suitable for increasing the turbulence of the expanding gas and disturbing the flow of expanding gas which travels along the internal cylindrical wall of the barrel when a ball is fired. Preferably, the grooves are circular in a plane substantially perpendicular to the longitudinal axis of the barrel and more than one groove is positioned along the length of the barrel as depicted more clearly in FIG. 3. Moreover, as also depicted in FIG. 3, grooves can be equally spaced along the length of the barrel and separated by openings in the barrel. Alternative arrangements would be apparent to the skilled artisan.

The barrel can be made of any suitable material, including metal or plastic. Preferably, the barrel is constructed from PVC plastic.

It is to be understood that although the invention has been described with particular reference to specific embodiments thereof, the form of the invention shown and described in detail is to be taken as the preferred embodiment of same, and that various changes and modifications may be resorted to without departing from the spirit and scope of the invention as defined in the appended claims.

The invention claimed is:

1. A cylindrical shaped barrel for use in an expanding gas powered ball machine to propel seamed balls, the barrel comprising:

a) plurality of openings in a cylindrical section of the barrel, such that the openings allow expanding gas to pass through the openings as a ball is fired through the barrel;

b) the barrel having a back end suitable for loading seamed balls and the barrel having a front distal end suitable for the exit of seamed balls;

c) the barrel having two sets openings with each set of openings comprising three or more rows of openings;

d) wherein the two sets of openings are opposed to one another;

e) wherein the two sets of openings are found within the first half of the barrel ,the first half of the barrel staring at the back end of the barrel; and f) wherein the barrel has an inner surface and the inner surface has a plurality of grooves that are circular in shape and in a plane substantially perpendicular to the longitudinal axis of the barrel, and wherein the plurality of grooves are spaced along the full length of the barrel.

2. The barrel of claim 1 wherein at least some of the grooves are separated by openings in the cylindrical section of the barrel.

3. The barrel of claim 1 wherein all of the grooves are separated by openings in the cylindrical section of the barrel.

4. A method of controlling the velocity of a seamed ball propelled from a barrel, the method comprising the steps of:

a. using a barrel with a plurality of openings in a cylindrical section of the barrel, the opening being comprised of two sets of opening, with each set comprising three rows of openings;

b. applying a known pressure and volume of gas through a first end of the barrel to propel a seamed ball from the first end of the barrel and past a second end of the barrel;

c. allowing gas to pass through the openings or the barrel as the seamed ball passes by the openings;

d. allowing gas to more uniformly propel the seamed ball by use of a plurality of grooves that are circular in shape and in a plane substantially perpendicular to the longitudinal axis of the barrel, and wherein the plurality of grooves are spaced along the full length of the barrel.

5. A barrel for use in conjunction with a ball machine, the ball machine being of the type which employs compressed gas to propel a loaded and seamed ball towards a target, the barrel comprising: a first opening in the barrel capable of receiving a seamed ball to be propelled from the ball machine; a second opening in the barrel through which a propelled seamed ball can exit the ball machine; 20 or more apertures in the barrel between the first and second openings; wherein the 20 or more apertures between the first and second openings are of a size and/or shape such that a ball to be used with the barrel is unable to pass through; and wherein the 20 or more apertures are comprised of two sets, with each set comprising three rows of apertures along the longitudinal axis of the barrel and wherein the two sets of apertures are on opposing sides of the barrel and wherein the barrel has an inner surface and the inner surface has a plurality of grooves that are circular in shape and in a plane substantially perpendicular to the longitudinal axis of the barrel, and wherein the plurality of grooves are spaced along the full length of the barrel.

* * * * *